US005202834A

United States Patent [19]

Gilham

[11] Patent Number: 5,202,834

[45] Date of Patent: Apr. 13, 1993

[54] MAIL ITEM PROCESSING SYSTEM

[75] Inventor: Dennis T. Gilham, Brentwood, United Kingdom

[73] Assignee: Alcatel Business Systems Limited, Essex, United Kingdom

[21] Appl. No.: 529,436

[22] Filed: May 29, 1990

[30] Foreign Application Priority Data

May 30, 1989 [GB] United Kingdom ..... 8912324

[51] Int. Cl.[5] ..... G07B 17/02

[52] U.S. Cl. ..... 364/464.02; 364/464.03

[58] Field of Search ..... 235/382, 375, 382.5; 364/464.02, 464.03, 466

[56] References Cited

U.S. PATENT DOCUMENTS

| | | | |
|---|---|---|---|
| 4,376,299 | 3/1983 | Rivest | 364/900 |
| 4,760,532 | 7/1988 | Sansone et al. | 235/375 X |
| 4,853,864 | 8/1989 | Hart et al. | 364/464.02 |
| 4,864,506 | 9/1989 | Storace | 364/464.02 |
| 4,907,161 | 3/1990 | Sansone et al. | 235/375 X |
| 4,947,333 | 8/1990 | Sansone et al. | 364/464.02 |
| 4,962,454 | 10/1990 | Sansone et al. | 364/464.02 |

*Primary Examiner*—Edward R. Cosimano

*Attorney, Agent, or Firm*—Shoemaker and Mattare Ltd.

[57] ABSTRACT

A mail processing system includes user terminals which communicate via the telephone network with a postal authority computer. When a batch of mail is to be processed, the postage charge for the batch of mail is transmitted to the computer which checks the credit status of the user and if satisfactory returns a transaction identification signal which enables the user terminal to print postage permits on the mail items and batch data on a batch label in machine readable form. For security the permit and batch label include a random number contained in the transaction identification signal. At a postal receiving location, the permits on the mail items and the batch label are machine read and compared with data relating to the batch held in the computer. If these items of data are consistent, the mail is accepted for delivery by the postal authority.

9 Claims, 1 Drawing Sheet

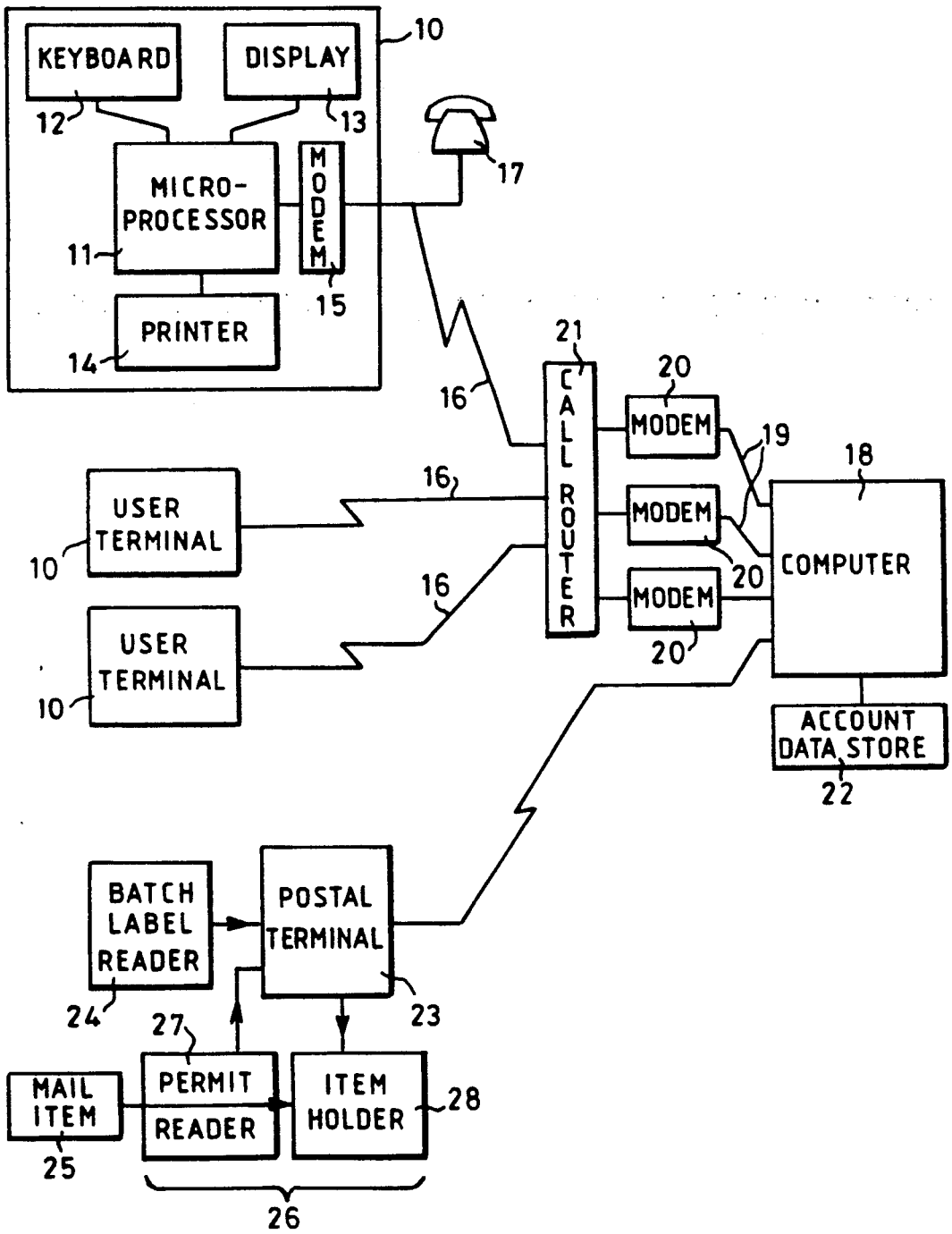
KEYBOARD
DISPLAY
10
12
13
MICRO-PROCESSOR
MODEM
17
11
15
PRINTER
14
21
CALL ROUTER
20
MODEM
19
18
16
USER TERMINAL
10
MODEM
COMPUTER
20
16
MODEM
USER TERMINAL
10
20
ACCOUNT DATA STORE
22
BATCH LABEL READER
POSTAL TERMINAL
24
23
27
PERMIT READER
ITEM HOLDER
28
MAIL ITEM
25
26

MAIL ITEM PROCESSING SYSTEM

BACKGROUND OF THE INVENTION

This invention relates to processing of mail items and in particular to systems for charging postage costs to a user of a postal service and for enabling verification that postage has been has been paid in respect of each postal item handled by the postal service.

As an alternative to the affixing of postage stamps purchased from a Postal Authority, franking machines are used to print a franking impression representing a selected postage charge on mail items. Such machines include a printing device for printing the franking impression and accounting means to maintain a record of accumulated value of postage used in franking and, when prepayment for postage is required, a record of credit remaining available for use in franking. The records maintained in the franking machine form the basis on which accounting and payment for postage charges incurred by a user is effected to the Postal Authority. Accordingly it is necessary that the records maintained in the franking machine are accurate and that the records cannot be tampered with in an attempt to defraud the Postal Authority. In order to ensure integrity of the data of the records when stored in electronic memory devices in the franking machine it is common to provide four sets of registers to store identical copies of the data. In operation of the franking meter, the data stored in the different sets of registers is checked periodically, for example prior to each franking cycle, to ascertain if the data in the register sets is identical. If any disparity is found between the records, the meter is caused to lock and prevent further franking until it has been checked by an authorised service engineer. By providing four sets of records, the data can be recovered from three of the sets of registers if one set is found to be storing erroneous data. In order to prevent attempts to use the meter fraudulently, unauthorised access to the registers and accounting circuits of the franking meter is physically inhibited by housing sensitive portions of the meter in a secure housing sealed by the Postal Authority. The need for provision of multiple sets of non-volatile registers to ensure integrity of the stored data and the need for physical security results in the manufacturing costs of franking meters being high.

Periodically, the franking meter has needed to be taken to the Postal Authority so that the Authority can check usage of the meter and obtain payment for the value of postage used. Where prepayment is required, the meter is taken to the Postal Authority whenever the amount of credit remaining recorded in the meter has decreased to a low value to enable the Postal Authority to reset the meter with additional credit in return for a further prepayment. In order to overcome the disadvantages inherent in the need for periodic return of the meter to the Postal Authority, reading of the contents of the registers and resetting the credit register may be carried out by communication via telephone connection with a resetting computer located at a Postal Authority centre. Alternatively register contents can be transferred from the meter to the resetting computer and credit resetting data transferred from the computer to the meter by means of a module containing an electronic data store and which can be connected alternately to the franking meter and the resetting computer and transported therebetween by the postal service.

SUMMARIES OF THE INVENTION

According to one aspect of the invention a mail item processing system includes a central computer system operative to maintain at least one user account record; at least one user terminal with means for communicating with the central computer system; means in the terminal operable to transmit a request to the computer system to enable printing of a total amount of postage value on a batch of postal items; said computer system being operative in response to said request to verify that funds are available for said total amount of postage value and to transmit a transaction confirmation indication to the terminal; said terminal being operative to print a postage permit on each mail item of a batch, the postage permit including said transaction indication, and to print a batch label or report including data relating to the total postage charge for the batch of items.

According to another aspect of the invention a method of processing mail items comprises:

at a mail sending location the steps of determining a postage charge in respect of a batch of mail items; transmitting to a computer at a postal authority location an identification corresponding to the mail sending location and postage charge data in respect of the batch of mail items; receiving an authorisation signal from the computer to enable a printing device at the mail sending location to print a postage permit on each mail item of the batch of mail items and to print batch data relating to the batch of mail items and the postage charge therefor on a batch label; and at a postal authority mail receiving location the steps of feeding the mail items of the batch past permit reading means to produce permit data signals; feeding the batch label past batch data reading means to produce batch data signals; communicating with the computer to receive the postage charge data; comparing the permit data signals, the batch data signals and the postage charge data and, in response to said comparison being successful, accepting the mail items of the batch for delivery to destination addresses.

BRIEF DESCRIPTION OF THE DRAWING

An embodiment of the invention will now be described by way of example with reference to the drawing which illustrates in block form the components of a system for processing mail items.

DESCRIPTION OF THE PREFERRED EMBODIMENT

A user terminal 10 is located in a user's office and comprises a micro-processor 11, a keyboard 12 for input of data by a user, a display device 13 for display of data to a user and a printer 14. The terminal is connected by means of a modem 15, which may be incorporated in the terminal or may be external to the terminal, to a telephone communication network 16. A telephone hand-set 17 may also be connected to the network. Other terminals 10 are located in the offices of other users.

A Postal Authority computer centre is provided with a computer system 18. The computer system 18 is provided with user communication ports 19, of which there may be several, connected by means of modems 20 to the telephone network. A call router 21 is provided to direct incoming calls from the telephone network to an available one of the modems 20. The computer system 18 is a fail safe system and may comprise a MIRA System as supplied by Digital Equipment Corp which integrates two fully duplicated Micro Vax processors operating as master and standby processors and linked via Ethernet. Software control of the system automatically detects any system failure and operates to switch between master and standby processors as required to maintain the system operational.

The computer system 18 includes storage means 22 for storing account data relating to a plurality of terminals located in different locations.

When it is desired to despatch mail items to the mail service, the user would batch together the mail items and enter on the keyboard 12 the postage charges for the mail items. For example, the entry may consist of 14 first class items and 35 second class items. The user then initiates by operation of a key on the keyboard, a sequence of steps in which the micro-processor 11 calculates the total postage charge and then auto-dials the computer system 18 at the remote computer centre. When communication with the computer system 18 has been achieved, the micro-processor transmits data to identify the specific terminal 10 to the computer and the amount of the total postage charge intended to be used. The computer system checks the account data stored in the storage means 22 relating to the identified terminal to determine whether there is sufficient credit available for the intended amount of postage charge. If there is sufficient credit available, the computer system updates the account data to reflect the current transaction and a set of instructions is transmitted to the terminal. This set of instructions includes a transaction confirmation number which permits the micro-processor 11 to operate the printer 14 to print permits corresponding to the mail item information initially entered on the keyboard of the terminal. Each printed permit includes the transaction confirmation number transmitted by the computer system 18 to the terminal 10 and may include an item number within the batch of items. These permits may be printed on a sequence of labels, one for each mail item or may be printed directly onto the mail items. In addition to the permits for each mail item a batch label is printed with data relating to the batch of mail items. This data includes the total postage charge for the batch of items. When permits are printed on labels, the labels are affixed to the corresponding mail items. The batch of mail items is then placed in a specially identified envelope on which the batch label is affixed and the envelope is placed into the postal service by being posted in any post box or post office. If desired instead of printing a batch label, the batch data may be printed directly onto the special envelope. Thus the printing comprises printing of a sequence of labels or the user may pass a batch of mail items followed by one of the special envelopes past the printer 14.

If desired, a report listing all the items of the batch may be printed in place of, or in addition to, the batch label.

Security is not required in the printed impression as regards colour or ink formulation but is provided by the printed transaction confirmation number. Accordingly generally available printing devices may be used for printing the permits. For example optical, electrostatic, thermal and ink jet digital printers may be used. While the printing device of a facsimile machine could be used it is preferred to use a printing device designed specifically for printing on mail items or labels. The labels may be printed on a label strip bearing fixed preprinted data.

The computer system 18 may be controlled to initiate automatically the crediting of additional funds to a user's account by incrementing the credit amount recorded in the user's account data stored in the storage means 22 whenever the credit available has fallen to a predetermined low level. The crediting of the user's account may be effected automatically by electronic funds transfer from a bank account. Alternatively the computer system may transmit a message to the terminal during a postage batch transaction for display on the display device 13 requesting the user to effect a payment for further postage.

If desired instead of maintaining a record of credit available for use against postage charges, the computer system may be programmed to initiate a funds transfer from a bank account in respect of each current batch transaction.

The maintenance of user account records in the storage means of the computer system 18 enables periodic statements of account to be printed out by the Postal Authority. Additionally the user may use the terminal 10 to request transmission from the computer system 18 of data from the user's account data. Such data may be printed out by the printer 14 of the terminal. Other reports may be printed out at the computer centre or at the terminal upon request by the user.

Mail handling centres of the Postal Authority are provided with terminals 23 communicating with the computer system 18, only one terminal 23 being shown in the drawing. A reader 24 operative to read data printed on the batch label affixed to the envelope containing a batch of mail items inputs this data to the terminal 23. Mail items such as envelopes 25 are fed through a mail handling system 26 which includes reading means 27 operative to read data from the permit printed on the envelopes or on labels affixed thereto and mail item holding apparatus 28. The data obtained from reading the envelopes by the reading means 27 is input to the terminal 23. The terminal checks the data read from a batch of mail items with the total data relating to the batch read from the batch label and in addition by communication of the terminal 23 with the computer system 18, a check is carried out to ensure that the data from the batch label is consistent with data stored in the computer as a result of the request for a batch transaction from a user's terminal 10. If the data from the computer system 18, the batch label and the mail items is consistent, the items of the batch held in the holding apparatus 28 are released for sorting and subsequent handling. Separate reading devices 24 and 27 may be provided as hereinbefore described. However if desired a single reading device may be utilised to read both the batch label or report and the permits on the mail items of the batch.

While sufficient security of the system may be provided by plain printing of the permit in visual and/or machine readable form additional security may be incorporated in the printed permit, and if desired in the batch label. This may be accomplished by using a complex imprint either in colour or form or in both colour and form. Alternatively the imprint may include data in coded form which is not easily decoded by visual inspection of the imprint. The coding may be accomplished by a coding device in the terminal 10 and decoding is accomplished by a corresponding decoding device in the terminal 23 at the Postal Authority. The coding device and decoding device may include pseudo-random number generators which step on in synchronism for each batch from a user's terminal. Alternatively the computer system 18 may generate a code which is included in the transaction confirmation number and this code when printed on the permits and batch label is checked with the code in the computer system 18 during communication of the terminal 23 with the computer system 18. When the code is generated by the computer system and the imprint is checked against the code generated by the computer system the code may be or contain a truly random number.

It will be appreciated that in the mail item processing system described hereinbefore, the user terminals 10 do not need to be constructed in a manner to provide security for postage funds. The terminal does not include registers, as are provided in a franking meter, to maintain an accurate record of postage value used or of credit available. Storage of such data is effected in the Postal Authority computer system and hence is always within the secure control of the Postal Authority. The terminal may, however, include non-volatile memory for user data registers if required, such user data registers being used to store data enabling a user to maintain, for example, records relating to usage of the terminal. Accordingly the terminal 10 may be constructed relatively inexpensively and generally consists of a printer for printing permits and batch labels and which can be controlled by keyboard input by a user together with means to permit communication with a central computer operated by the Postal Authority which performs all the required accounting functions and provides control data in the form of a transaction confirmation number or identification to enable verification of payment for postage charges on items of a batch of mail items.

I claim:

1. A mail item processing system including a central computer system operative to maintain at least one user account record; at least one user terminal with means for communicating with the central computer system; means in the terminal operable to transmit a request to the computer system to enable printing of a total amount of postage value on a batch of postal items; said computer system being operative in response to said request to verify that funds are available for said total amount of postage value and to transmit a transaction confirmation indication to the terminal; said terminal being operative to print a postage permit on each mail item of said batch, the postage permit including said transaction indication, and to print a batch report including data relating to the total postage charge for said batch of items and including a postal terminal located at a mail receiving location; communication means providing communication between said postal terminal and said computer system; said terminal including means operable to read data relating to said total postage charge for said batch of mail items from said batch report and operable to read data from said postage permits printed on mail items of said batch; and means to verify that the data read from said postage permits, the data read from said batch report and data held by the computer system relating to said batch of mail items is consistent.

2. A mail item processing system as claimed in claim 1 in which the transaction indication comprises a pseudo-random number.

3. A mail item processing system as claimed in claim 1 in which the transaction indication comprises a random number.

4. A mail item processing system as claimed in claim 1 wherein the permit includes at least a portion printed in coded form and the postal terminal includes means responsive to said portion printed in coded form.

5. A mail item processing system as claimed in claim 1 in which the printing permit includes at least a portion in machine readable form.

6. A mail item processing system as claimed in claim 1 in which at least a portion of data printed on the batch report is in machine readable form.

7. A mail item processing system as claimed in claim 1 wherein the postal terminal includes means to retain the batch of mail items after reading of the postage permits; said means being operative to release the mail items of the batch in response to the data read from the permits, the data read from the batch label and data held by the computer system being consistent with one another.

8. A method of processing mail items comprising:

at a mail sending location the steps of determining a postage charge in respect of a batch of mail items; transmitting to a computer at a postal authority location an identification corresponding to the mail sending location and postage charge data in respect of the batch of mail items; receiving an authorization signal from the computer to enable a printing device at the mail sending location to print a postage permit on each mail item of the batch of mail items and to print batch data relating to the batch of mail items and the postage charge therefor on a batch label; and at a postal authority mail receiving location the steps of feeding the mail items of the batch past permit reading means to produce permit data signals; feeding the batch label past batch data reading means to produce batch data signals; communicating with the computer to receive the postage charge data; comparing the permit data signals, the batch data signals and the postage charge data and, in response to said comparison being successful, accepting the mail items of the batch for delivery to destination addresses.

9. A mail item processing system including a computer system located at a postal authority location and operative to maintain at least one user account record; at least one user terminal located at a mail sending location provided with communication means operable to effect communication between the user terminal and the computer system; means in the terminal operable to transmit a request to the computer system to enable printing of a total amount of postage value on a batch of postal items; said computer system being operative in response to said request to verify that funds are available for said total amount of postage value and to transmit a transaction indication to the user terminal; said user terminal being operative in response to receipt of said transaction indication to print a postage permit on each mail item of said batch, said postage permit including said transaction indication, and to print a batch label including batch data relating to the total postage charge for the batch of mail items and including a postal terminal located at a postal authority mail receiving location and connected for communication with the computer system; said postal terminal including batch label reading means operable to read data relating to said total postage charge for said batch of mail items from said batch label and permit reading means operable to read permit data from said permits printed on mail items of said batch; mail item retaining means to hold the mail items of said batch after reading of said permits; comparison means operative to verify that the permit data read from said permits, the batch data read from said batch label and data held by the computer system relating to said batch of mail items is consistent and to release said mail items from said mail item retaining means if said permit data, said batch data and said data held by said computer system are consistent.

* * * * *